US005141544A

United States Patent [19]

Butts

[11] Patent Number: 5,141,544

[45] Date of Patent: Aug. 25, 1992

[54] NITROGEN REJECTION UNIT

[76] Inventor: Rayburn C. Butts, Beck Engineering, Inc., 3100 North A, Bldg. C., Midland, Tex. 789705

[21] Appl. No.: 682,287

[22] Filed: Apr. 9, 1991

[51] Int. Cl.[5] ..... F25J 3/06

[52] U.S. Cl. ..... 62/23; 62/37; 62/43

[58] Field of Search ..... 62/23, 24, 43, 37

[56] References Cited

U.S. PATENT DOCUMENTS

| | | | |
|---|---|---|---|
| 3,625,016 | 12/1971 | Hoffman | 62/26 |
| 3,625,027 | 12/1971 | Hoffman | 62/16 |
| 3,901,673 | 8/1975 | Zahn et al. | 62/23 |
| 4,142,876 | 3/1979 | Zahn et al. | 62/23 |
| 4,203,742 | 5/1980 | Agnihotri | 62/24 |
| 4,451,275 | 5/1984 | Vines et al. | 62/28 |
| 4,453,958 | 6/1984 | Gulsby et al. | 62/28 |
| 4,456,461 | 6/1984 | Perez | 62/28 |
| 4,526,595 | 7/1985 | McNeil | 62/28 |
| 4,609,390 | 9/1986 | Wilson | 62/21 |
| 4,657,571 | 4/1987 | Gazzi | 62/23 |
| 4,675,035 | 6/1987 | Apffel | 62/17 |
| 4,762,543 | 8/1988 | Pantermuehl et al. | 62/28 |
| 4,854,955 | 8/1989 | Campbell et al. | 62/24 |
| 4,861,360 | 8/1989 | Apffel | 62/17 |
| 4,948,405 | 8/1990 | Thompson | 62/43 |

*Primary Examiner*—Ronald G. Capossela

*Attorney, Agent, or Firm*—Marcus L. Bates

[57] ABSTRACT

A process for separating nitrogen and hydrocarbons from a mixture of gases by splitting the mixture into a plurality of separate streams and throttling the flow of each stream to achieve a selected variable flow rate therebetween. The plurality of separate streams and individually cooled by exchanging heat with a plurality of different process streams, then the cooled separate streams are combined, cooled by another process stream, and again cooled by expansion. The cooled combined streams then enter a separation column where nitrogen ascends the column and exits as a process stream while hydrocarbon descends the column to a reboiler therof and exits as another process stream. The reboiler is used for cooling one of the separate streams and is therefore one of the process streams. The hydrocarbon from the column is expanded and used for the processe stream that first cools the combined streams and thereafter cools another of the separate streams and then is discharged from the process. The nitrogen process stream is expanded and used to cool another of the separate streams, and then is discharged from the process. The flow rates are controlled to maintain the throttling of the split streams and the pressure drop across the expansion valves within an optimum range of predetermined values.

12 Claims, 2 Drawing Sheets

RESIDUE GAS
NITROGEN OUT
SALES GAS
FUEL GAS
N2 BACK PRES
PRIMARY JT 1
N2-REJECT
N2-LEVEL VA
COLD GAS/LIQ
GAS /GAS EX
MIXER
WARM GAS/LIQ
N2-REBOILER
DIVIDER
ELECTRONIC SIGNAL TO END DEVICES
ELECTRONIC SIGNAL FROM SENSORS
COMPUTER
OUTPUT
INPUT
OPERATOR CONSOLE
ALARM
TRENDS CONSOLE

NITROGEN REJECTION UNIT

BACKGROUND OF THE INVENTION

This invention discloses a novel nitrogen extraction unit by which varying amounts of excess nitrogen are removed from a natural gas stream. Transporting pipelines usually accept natural gas containing up to a maximum of four mole percent total inerts In this disclosure, total inerts are calculated as the sum of carbon dioxide, nitrogen, helium and other non-hydrocarbon gasses. Carbon dioxide is easily removed by various commercial methods, as for example as taught by U.S. Pat. No. 4,762,543; however, nitrogen, helium and argon are not as chemically reactive and, therefore, cannot be removed as easily or generally by the same methods as carbon dioxide. Nitrogen, helium, argon and other atomically light gasses physically act in similar manners at very low temperatures, therefore it will be understood that reference only to nitrogen in the remainder of this description also includes these other gases.

Commercial removal of nitrogen is presently accomplished by fractionation under cryogenic conditions, as seen, for example in U.S. Pat. Nos. 4,451,275, 4,675,035, 4,609,390 and 4,526,595. Present nitrogen extraction methods achieve a high degree of nitrogen purity, but at a high cost in initial plant equipment and refrigeration horsepower. Examples of these and other processes are shown in the accompanying Prior Art Statement.

The nitrogen removal method and apparatus presented herein uses no external refrigeration equipment and is considerably less expensive than known existing conventional methods. The thermal drive mechanism for the process utilizes a series of Joule-Thomson expansion valves (sometimes hereinafter referred to as a JT valve), the optimum physical placement of cross heat exchangers, and computer-based automatic control of cross heat exchanger loading and temperature monitoring.

SUMMARY OF THE INVENTION

The present invention provides both method and apparatus for separating nitrogen and hydrocarbon vapor from a mixture thereof wherein the mixture enters the system at a relatively high pressure and provides the energy for effecting the separation by the employment of the Joule-Thomson effect to selected process streams.

More specifically, the process, according to the invention, comprises separation of a feed gas that is a mixture of nitrogen and hydrocarbon vapor. The feed gas is split into a plurality of separate streams, each of which is throttled to achieve a selected variable flow rate therebetween. Each of the split streams is cooled by exchanging heat with one of an exiting process stream. The split streams are recombined and again cooled by exchanging heat with another process stream. Then the recombined cooled streams expand to the internal pressure of a nitrogen reject column where the nitrogen and hydrocarbon are separated and exit in separate streams therefrom. Each separated stream is expanded and used for the recited step of cooling the combined streams and also for the recited step of cooling the plurality of streams.

Accordingly, a primary object of the present invention is the provision of both method and apparatus for the separation of nitrogen and hydrocarbons from a mixture thereof.

Another object of the present invention is the provision of a system by which a separation process is carried out and wherein nitrogen and hydrocarbons are separated from a mixture thereof while utilizing the pressure drop of the various process streams for the thermal drive of the system.

A further object of this invention is the provision of a system for separating nitrogen and hydrocarbons from a relatively high pressure mixture thereof by splitting the mixture into a plurality of streams, cooling each split stream of the mixture by expansion of various downstream process streams which exchange heat with the split streams, and then effecting a separation in a separation column.

A still further object of this invention is the provision of a method of separating nitrogen and hydrocarbons from a high pressure mixture thereof by utilizing the pressure drop of various process streams thereof for the thermal drive of the system and controlling the various flow rates with a computer.

Another and still further object of this invention is the provision of a process by which nitrogen is removed from produced compressible fluid obtained from a wellbore by splitting the compressible fluid into a plurality of streams, cooling each split stream of the mixture by expansion of various downstream process streams which exchange heat with the split streams, and thereafter effecting a separation of the nitrogen from the residual compressible fluid in a separation column.

These and other objects and advantages of the present invention will become readily apparent to those skilled in the art upon reading the following detailed description and claims and by referring to the accompanying drawings.

The above objects are attained in accordance with the present invention by the provision of a method for use with apparatus fabricated in a manner substantially as described herein.

DETAILED DESCRIPTION OF THE DRAWINGS

Figure 1:
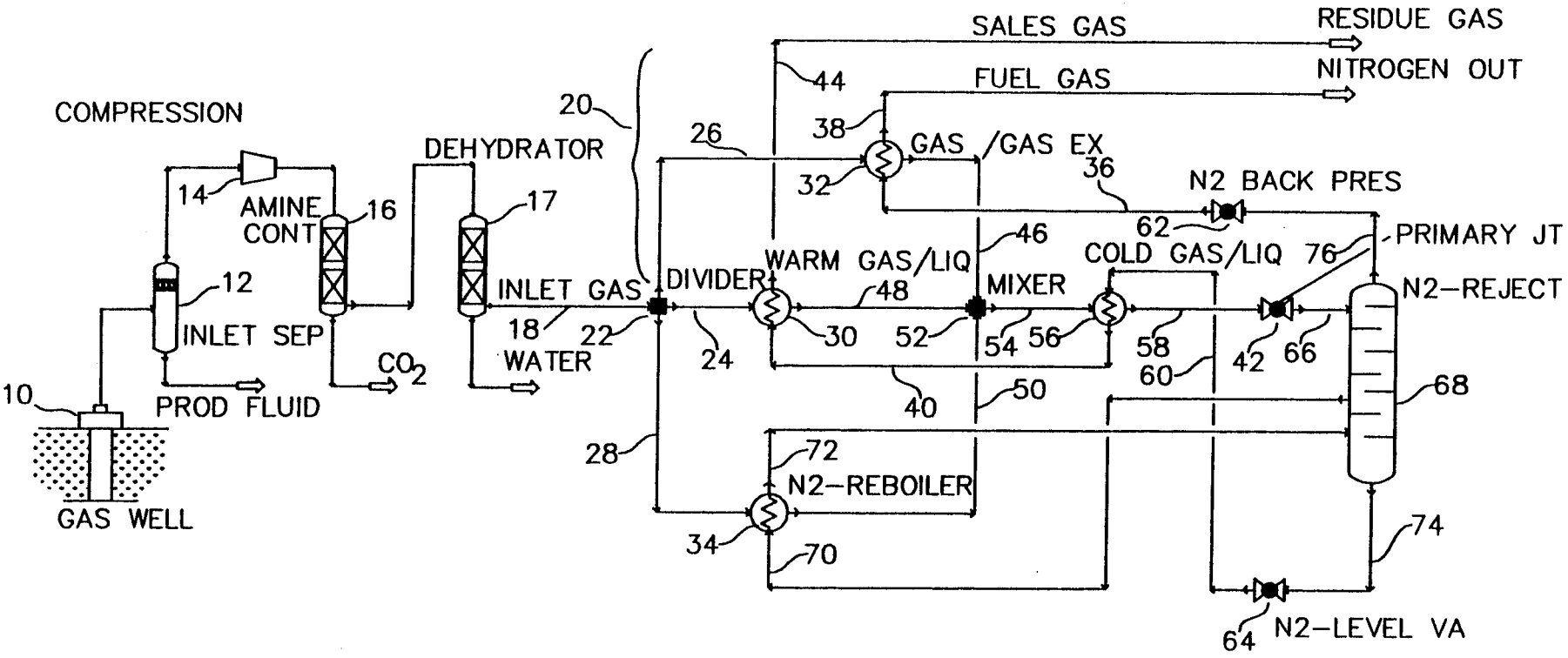
FIG. 1 of the drawing is a diagrammatical representation of a system made in accordance with the present invention for removing nitrogen and hydrocarbons from a mixture thereof; and, FIG. 2 is a diagrammatical representation that includes a control means for operation of the system of FIG. 1.

In FIG. 1 of the drawings, the wellhead of a gas well 10 is connected to convey produced fluid therefrom into an inlet separator 12 where liquid hydrocarbons, gas, water, and unwanted debris are separated from the produced fluids, as shown. The gas is then compressed at 14 to a relatively high pressure. The mixture continues to an amine contactor 16 where CO2 and H2S are removed. The mixture continues to a dehydration vessel 17 where water is removed prior to introduction at 18 into a nitrogen rejection unit 20.

In one specific embodiment of the invention, the nitrogen rejection unit 20 receives feed gas at inlet 18 from the upstream gas compression and treating unit to provide an inlet pressure of between 700 and 1000 PSIG. The carbon dioxide preferably has been reduced to a level of 0.1% mole volume or to less than 1000 parts per million (PPM) by the upstream treating unit 16. This level of CO2 removal is easily accomplished by known conventional chemical extraction methods, using a known amine derivative (MEA or DEA), for example. Water vapor is extracted from the inlet stream at dehydration vessel 17, utilizing commercially available dehydration techniques, such as a molecular sieve, for example. The feed gas at inlet stream 18 preferably has an inlet water dew point of less than −250 degrees F.

The inlet feed gas 18 may, however, have up to 70% by volume nitrogen as well as other hydrocarbon or non-hydrocarbon components. Hence, the inlet feed gas stream 18 must be low in water and carbon dioxide content and at a pressure between 700 and 1000 PSIG; as well as being between 60 and 130 degrees F.

In FIG. 1, the inlet feed stream 18 is split or divided at valve means 22 into a plurality of streams 24, 26, and 28, respectively, which flow to the primary side of a plurality of exchangers 30, 32 and 34, respectively.

The primary side of the exchangers 30, 32 and 34 is arranged in parallel relationship respective to one another. A computer based control means (see FIG. 2) provides optimum inlet gas division during operation of the nitrogen rejection unit 20 and allows for a minimum start-up time. The gas-to-gas exchanger 32 is the primary exchanger during the initial phases start-up, and during the first few hours of operation the computer routes all of the inlet gas stream into the split stream 26. Nitrogen rich off gas enters the secondary side of exchanger 32 as stream 36 and exits the system as stream 38. The computer-based operation set forth herein allows for an optimized "bootstrap" start-up.

The warm gas-to-liquid exchanger 30 absorbs heat from the split inlet gas stream 24 by cross exchange with the intermediate residue gas stream 40. The computer commences to route the inlet gas from feed inlet 18 into the stream 24 upon reading a thermal gradient between streams 38 and 44. When condensation occurs in the nitrogen rejection column 68, liquid hydrocarbon is routed through the downstream equipment, as explained later on in this disclosure, and eventually exits the system as outlet stream 44. As the cool fluid commences to exit the system in stream 44, the temperature will drop and the computer will begin to change the inlet gas split at valve 22 by routing some of the inlet gas at stream 26 from the gas-to-gas exchanger 32 to the warm gas-to-liquid exchanger 30.

The exchanger 34 is a nitrogen reject column reboiler that removes heat from the inlet gas stream 28 by cross exchange with hydrocarbon liquid generated from down stream processing. The computer control will begin to route a portion of the inlet feed gas stream 18 to exchanger 34 after the predefined column bottom temperature has been reached, according to FIG. 2.

Stream 46 exits the gas-to-gas exchanger 32 at a temperature of approximately −135 degrees F. and typically contains some condensed liquid hydrocarbon mixed with hydrocarbon vapor. Stream 48 exits the warm gas to liquid exchanger 30 at an average temperature of −215 degrees F. and typically contains some liquid hydrocarbon entrained in hydrocarbon vapor. Stream 50 exits the nitrogen reject column reboiler 34 at an average temperature of −205 degrees F. and, as in stream 46, usually contains some liquid hydrocarbon. The three streams 46, 48 and 50 are mixed together in a mixer block 52 to provide a mixed stream 54. The mixed stream 54 exits the mixer block 52 at an appropriate temperature of −205 degrees F. and a pressure only 10 to 20 PSI less than the feed stream 18. Stream 54 continues to the cold gas-to-liquid exchanger 56 where it is cooled to approximately −210 degrees F. and exits the exchanger as stream 58. The cold gas-to-liquid exchanger 56 rejects heat from the incoming stream 54 by cross exchange with stream 60. The placement of exchanger 56 is critical to the start-up and to the continuous operation of the process.

Stream 58 is normally a subcooled liquid before entering the primary expansion valve 42 of three expansion control valves 42, 62 and 64.

The primary JT valve 42 provides the first critical pressure reduction from approximately 900 PSIA to 175 PSIA as the stream at 66 expands to the pressure of the separation column 68. This expansion provides a portion of the required nitrogen rejection unit cooling by utilizing the well known Joule-Thomson (JT) effect. Stream 66 exits the primary JT valve 42 at an appropriate temperature of −215 degrees F. The primary JT valve 42 provides critical and significant inlet stream gas cooling during the start-up phases of operation; however, after start-up and during steady state operation, the primary JT valve 42 provides less actual thermal cooling, but provides the necessary pressure reduction required for optimum nitrogen and hydrocarbon separation within the nitrogen rejection separator column 68.

The nitrogen reject or separation column 68 is critical to the nitrogen rejection unit 20 as it provides for the actual separation of the mixture of nitrogen and hydrocarbons. The nitrogen reject column 68 is fed by stream 66 at approximately −215 degrees F. and 170 PSIA pressure. This stream is approximately 3 to 10 mole percent vapor, depending on inlet gas composition. The liquid phase of stream 66 usually contains in excess of 5 mole percent nitrogen. Since the residue or sales gas typically has an upper nitrogen content limit of 4 mole percent, the excess nitrogen must be rejected from the liquid phase of the mixture entering the column in stream 66.

Streams 70 and 72 connect the lower end of the column 68 to the nitrogen reject column reboiler 34. Stream 70 is at approximately −204 degrees F. and is substantially 100% liquid that is comprised primarily of hydrocarbon with some entrained nitrogen. This liquid stream is routed to the reboiler where it is heated by cross exchange with the split or divided inlet gas stream 28. Stream 72 exits the reboiler 34 in both the liquid and vapor phase and at an approximate temperature of −193 degrees F. The reboiler 34 provides the required heat to the bottom of the column 68 for the necessary stripping vapor internal to the column 68. The ascending stripping vapor "strips" nitrogen from the liquid hydrocarbon flowing downward from the top of the column where the stream 66 enters and travels to the bottom where it exits as stream 74 (disregarding streams 70, 72). This stripping vapor (in combination with heat added in the reboiler 34) removes nitrogen from the stream exiting the column at stream 74 as required to meet the pipeline quality specification.

Stream 66 enters the column at an appropriate temperature of −215 degrees F. and a pressure of near 170 PSIA. The nitrogen rich column overhead stream exits the column as stream 76 as substantially 100% vapor and at a temperature of near −215 degrees F. and 170 PSIA pressure. This column overhead stream 76 contains the rejected nitrogen and some entrained hydrocarbon, primarily methane. Stream 76 continues to the second JT expansion control valve 62 which is labeled "N2 BACK PRES". This expansion control valve 62 reduces the pressure of stream 76 to about 65 PSIA and further cools stream 76 to approximately −235 degrees F. at stream 36. Stream 36 is then routed to the gas-to-gas exchanger 32 for cross exchange therewithin. As mentioned above, this cross exchange provides heat removal from the split inlet stream 26 as required for process initiation and for partial cooling requirements during a steady state operation.

Stream 74 exits the column bottom stripped of excess nitrogen and is routed to the third JT expansion control valve 64. Stream 74 is at an approximate temperature of −193 degrees F. and at a pressure of about 1170 PSIA and is 100% liquid. Note that the differential temperature across the column of stream 76 and stream 74 is due to the addition of heat in the nitrogen reject column reboiler 34. Stream 74 is routed to the third JT expansion control valve 64 (labeled "N2-LEVEL VA") where further pressure reduction is performed. The pressure at this level valve is reduced from near 170 PSIA to approximately 65 PSIA, while the temperature changes from −195 degrees F. in stream 74 to −225 degrees F. in stream 60. Stream 60 exits the expansion control valve 64 as a two phase fluid and is routed to the cold gas-to-liquid exchanger 56. Stream 60 is cross exchanged with stream 54 as previously explained, and exits the exchanger 56 as stream 40. Since stream 60 is largely liquid and since an additional 5 to 10 PSI pressure drop can be expected through the cold gas-to-liquid exchanger 56, stream 40 will be at or near the same temperature as stream 60. The heat absorbed into stream 60 vaporizes a portion of the liquid hydrocarbon present without increasing the temperature in stream 40. For example, stream 60 may enter the exchanger at −223 degrees F. and be approximately 15% vapor by mole volume and exits as stream 40 with a temperature of −224 degrees F. at 22% vapor by mole volume. The latent heat of vaporization of the 7% (22%–15%) provides the thermal drive for this exchanger under steady state conditions.

Stream 40 is then routed to the warm gas-to-liquid exchanger 30 where it exchanges heat with the split inlet gas stream 24 and exits the nitrogen rejection unit as stream 44 at or near ambient temperature.

The heat exchanger arrangement, sizing, and control provide maximum inlet gas cooling with minimum equipment. The computer aided inlet gas split aspect of this process is a unique and unobvious feature. This feature automatically modifies the amount of inlet gas 18 routed to each exchanger 30–34 in response to changing temperature parameters encountered during initial facility start-up and during the normal facility operation.

Figure 2:
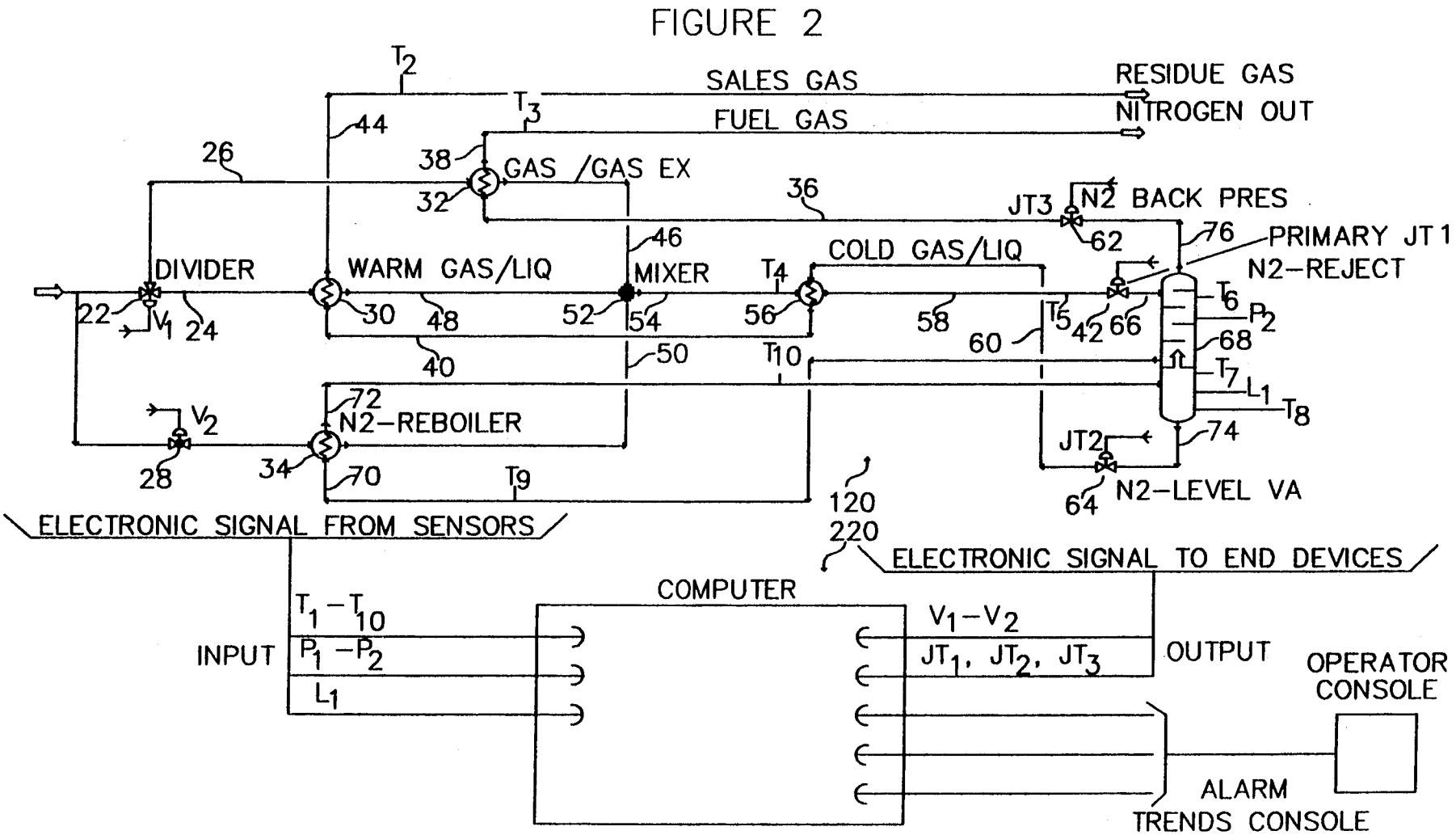

FIG. 2 is a diagrammatical representation of a computer 220 configured to sense the operational variables of the nitrogen recovery unit 120, which includes the system of FIG. 1 therein, and additionally includes the illustrated sensors for measuring the temperature variables at T1–T10. Pressure measurements are made at locations indicated by P1 and P2 and level control is accomplished at a location indicated as L1. These measurements are required to generate a corresponding signal related to the measurements and thereby input sufficient data in proper form to computer 220 for enabling the computer to determine the existing temperature, pressure, and process level; then for the computer to compare this actual operational data to stored data contained in the computer memory. The stored data includes ideal operational values and instructions to enable the computer to select the logical changes to be effected in the controllable variables in order to achieve optimum operation of the system.

More specifically, the measurements are ascertained using known means for making measurements, and converted into suitable signals that correspond to the measured data, wherein the data can then be comprehended by the computer, so that the signals can be analyzed by the computer. The results of the analyzed data are compared by the computer to operational data previously stored in the computer memory to determine the changes that should be made to the various flow rates in order to change the flow rates to achieve the most optimum operation of the nitrogen rejection unit 20.

As seen in FIG. 2, the changes are manifested in the nitrogen rejection unit 120 by the computer generated output signals that are converted by a suitable transducer into a proper operational signal. The operational signal is connected to actuate the appropriate valve devices V1, V2, JT1, JT2, and JT3.

One example of a flow control valve that can advantageously be used at V1 is a Fisher type YD valve. V2 may be a Fisher type E series valve. One example of an expansion valve that advantageously can be employed at JT1–JT3 is a Fisher cryogenically modified type E stainless steel valve.

One example of a computer 220 that can be used in conjunction with the nitrogen rejection unit 20 is a Hewlett Packard Vectra 386 style computer.

All sensors utilized are well known to those skilled in the art along with the means for generating a suitable signal that is compatible with the computer.

There are any number of known computers that can be programed by those skilled in the art to analyze the input data of the system and make the most logical and optimum selection of operational flow rates in order to achieve the maximum efficiency of operation of the system in accordance with this invention.

The method and apparatus of this invention provides a hydrocarbon vapor stream containing allowable amounts of nitrogen at near ambient temperature. The pressure of this gas stream at 44 is near 60 PSIA and will sometimes require final compression if the sales pipeline injection is above that pressure. The nitrogen rich off gas stream typically has a heating value of 300 to 600 BTU/cubic foot. This stream may be routed directly to any fuel gas demand where a low quality fuel can be tolerated. Typical acceptable fuel gas users which are normally present at a gas processing or treating facility would include the following:

1. Amine unit regenerator;
2. Inlet gas compression;
3. Post nitrogen rejection unit compression;
4. Molecular sieve regeneration heater.

The gas compressors are typically driven by conventional turbine or internal combustion gas engines which can be modified to combust the low BTU gas from the nitrogen rejection unit 20. The nitrogen rejection unit 20 does not produce any toxic or dangerous by products.

I claim:

1. A system for separating nitrogen and hydrocarbon from a mixture thereof, comprising:

means for elevating the pressure of said mixture to provide a feed gas; first, second, and third heat exchangers having a primary side thereof arranged in parallel; feed valve means connecting said feed gas to the primary side of said first, second, and third heat exchangers to split the feed gas into three streams and to throttle the flow of said three streams and thereby achieve a selected flow rate therebetween;

a fourth heat exchanger having a primary side connected in series with the primary side of said first, second, and third heat exchangers to recombine the three streams and remove heat from said three streams; a separator column including a reboiler, a first expansion valve means connecting said fourth heat exchanger to said separator column and reducing the temperature of the fluid flowing therethrough while reducing the pressure to that of the column;

a hydrocarbon gas outlet; a second expansion valve means connecting the bottom of separator column to flow through the secondary of said fourth heat exchanger, and then to the secondary of the first heat exchanger, and then to said hydrocarbon gas outlet;

a nitrogen gas outlet; a third expansion valve means connecting the top of the separator column to the secondary of said second heat exchanger and then to said nitrogen gas outlet;

and computer means by which the feed valve means, the three expansion valves, and the reboiler temperature are adjusted within an optimum range for separating the nitrogen from the mixture.

2. The system of claim 1 wherein the separated nitrogen is mixed with hydrocarbon to provide a combustion gas of low BTU while the nitrogen content of the separated hydrocarbon is adjusted to a value which is one half of one mole percent (0.5%) by volume.

3. The system of claim 1 wherein the flow rates through the heat exchangers and the expansion valves are controlled to provide an optimum condition for separation of the nitrogen and hydrocarbon by the provision of sensor means to measure the fluid temperatures exiting the first, second and third heat exchangers and control parameters as required to control the first, second, and third expansion valves; controller means connected to control the flow rate through said first, second and third heat exchanger and through said first, second and third expansion valves and thereby select the optimum condition of operation.

4. A process for separating nitrogen and hydrocarbon from a mixture thereof and flowing the separated nitrogen to exhaust piping means and flowing the separated hydrocarbon to discharge piping means, comprising the steps of:

adjusting the pressure of said mixture to provide a relatively high pressure feed gas respective to said discharge pressure; splitting the feed gas into a plurality of separate streams and throttling the flow of each of said separate streams to achieve a selected variable flow rate therebetween;

cooling the separate streams by passing said plurality of separate streams through the primary side of a plurality of heat exchangers having the primary side thereof arranged in parallel respective to one another;

recombining the cooled split streams and thereafter passing the recombined stream through the primary of another heat exchanger that is in series relationship respective to said primary sides of said plurality of heat exchangers to remove heat therefrom, and flowing the recombined cooled stream through an expansion valve to further lower the temperature thereof, and then flowing the cooled recombined stream into a nitrogen rejection column where the lighter fractions including nitrogen ascend in the nitrogen rejection column while the heavier fractions including hydrocarbon descend in the nitrogen rejection column and flow through a reboiler thereof;

cooling the hydrocarbon from the nitrogen rejection column bottoms in a second expansion valve that s series connected between said nitrogen rejection column and said another heat exchanger and the secondary of at least one of the plurality of heat exchangers and thence to the discharge piping means;

passing the nitrogen from the nitrogen rejection column through a third expansion valve means, and to the secondary of another heat exchanger and thence to the exhaust piping means.

5. The process of claim 4 and further including the steps of compressing and cooling the inlet mixture to achieve an inlet stream having about 900 PSI and 100 degrees F.;

said plurality of streams includes a first, second, and third stream, respectively, connected to first, second, and third heat exchanger primaries, respectively.

6. The process of claim 4 and further including the steps of mixing hydrocarbons with the separated nitrogen to provide a combustion gas of low BTU.

7. A method of separating nitrogen and hydrocarbon from a mixture thereof wherein said mixture is a high pressure feed gas; and flowing the separated nitrogen to outlet means and flowing the separated hydrocarbon to a discharge means, comprising the steps of:

splitting the feed gas into three streams and throttling the flow of each of said three streams to achieve a selected variable flow rate therebetween; cooling each of the split feed gas streams by passing the first, second, and third stream, respectively, of said three streams through the primary of first, second, and third heat exchangers, respectively, which are arranged in parallel; recombining the cooled first, second, and third streams and thereafter passing the recombined stream through a fourth heat exchanger that is in series relationship respective to the primary side of said first, second, and third head exchangers to remove heat therefrom, and then flowing the cooled recombined stream to an expansion valve and from the expansion valve into a nitrogen rejection column where the lighter fractions, including nitrogen, ascend the nitrogen rejection column while the heavier fractions, including hydrocarbon, descend the nitrogen rejection column and flow through a reboiler thereof;

cooling the hydrocarbon from the reboiler of the nitrogen rejection column in a second expansion valve that is connected in series between said reboiler and the secondary of the fourth heat exchanger and the secondary of the first heat exchanger, and thence to the hydrocarbon discharge means;

passing the nitrogen from the nitrogen rejection column through a third expansion valve that is series connected to the secondary of the second heat exchanger and thence to the nitrogen outlet means.

8. The method of claim 7 wherein the nitrogen at the nitrogen outlet means is contaminated with hydrocarbon to provide a combustion gas of low BTU content, and adjusting the nitrogen content of the hydrocarbon at the hydrocarbon discharge means to a value greater than 0.5 mole percent by volume.

9. The method of claim 7 and further including the steps of controlling the flow rates of the split streams with a computer that modifies the amount of feed gas routed to each exchanger in response to changing temperature parameters encountered during the normal facility operation.

10. The method of claim 7 and further including the steps of controlling the flow rate of the three split streams by means of a computer connected to provide control of the split streams, the pressure drop across each expansion valve, and a reboiler temperature within a range that optimizes the separation operation.

11. A method of separating nitrogen and hydrocarbon from a mixture thereof and flowing the separated nitrogen and the separated hydrocarbon to separate collection means, comprising the steps of:

splitting a stream of relatively high pressure feed gas containing said mixture into a first, second, and third split stream, and throttling the flow of each of the three split streams to achieve a selected variable flow rate therebetween;

cooling the three split streams by passing said first, second, and third split stream, respectively, through a primary side of a first, second, and third heat exchanger, respectively;

combining the three cooled split streams and then further cooling the combined three cooled split streams by passing the combined streams through a primary side of another heat exchanger; and, expanding the further cooled combined streams into a separation column where the nitrogen and hydrocarbon are separated and exit in separate streams therefrom;

expanding the separated stream of hydrocarbon to reduce the temperature thereof and thereafter using the expanded cooled stream of hydrocarbon for the recited step of cooling the combined streams and also for the recited step of cooling the first split stream by flowing the expanded cooled stream of hydrocarbon through the secondary of said another heat exchanger and through the secondary of the first heat exchanger while the first stream and recombined stream flows through the primaries thereof, and then flowing the heated stream of hydrocarbon from the secondary of the heat exchangers to said collection means;

expanding the separated stream of nitrogen to lower the temperature thereof; flowing the expanded cooled stream of nitrogen through the secondary of the second heat exchanger to cool the second split stream which flows in heat transfer relationship therewith;

carrying out the step of cooling the third split stream by using the secondary of the third heat exchanger as a reboiler for the separation column.

12. The method of claim 11 and further including the steps of:

controlling the flow rate of the three split streams by means of a computer connected to actuate a valve means that throttles the flow of the three split streams in response to the downstream temperatures and pressures and provides control of the relative flow rates of the three split streams to achieve the optimum cooling and pressure drop across each expansion valve, and to maintain the reboiler temperature within a range that optimizes the separation operation.

* * * * *